US006547283B1

(12) United States Patent
Moor

(10) Patent No.: US 6,547,283 B1
(45) Date of Patent: Apr. 15, 2003

(54) MOUNTING SYSTEM FOR A PORTFOLIO

(75) Inventor: Marc L. Moor, Oakwood, OH (US)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/611,544

(22) Filed: Jul. 7, 2000

(51) Int. Cl.[7] ..... B42D 17/00

(52) U.S. Cl. ..... 281/44; 281/9; 281/14; 281/15.1; 281/31; 281/37; 281/50; 281/51; 283/61; 283/62; 283/65; 283/117; 40/124.05; 40/124.06; 40/373; 40/377; 40/379; 40/380; 40/383; 40/401; 40/404; 40/405; 40/752; 40/753; 40/768; 40/770; 40/777; 206/214; 206/232; 206/472; 206/473; 206/474; 206/476; 206/482; 206/487; 150/112; 150/135

(58) Field of Search ..... 281/9, 14, 15.1, 281/31, 37, 44, 50, 51; 283/61, 62, 65, 117; 40/124.05, 124.06, 373, 377, 379, 380, 383, 401, 404, 405, 752, 753, 768, 770, 777; 206/214, 232, 472, 474, 473, 476, 482, 487; 150/112, 135

(56) References Cited

U.S. PATENT DOCUMENTS

| | | | | | |
|---|---|---|---|---|---|
| 195,248 | A | | 9/1877 | Austin | |
| 1,302,848 | A | * | 5/1919 | Rand | 283/65 |
| 1,476,662 | A | * | 12/1923 | Weinacht | 40/777 |
| 2,299,319 | A | | 10/1942 | Gale | 281/19 |
| 2,306,324 | A | * | 12/1942 | Stark | 281/50 |
| 2,568,178 | A | * | 9/1951 | Widder | 40/768 |
| 2,737,220 | A | * | 3/1956 | Hoff | 150/135 |
| D182,059 | S | | 2/1958 | Chase | D87/5 |
| 3,221,751 | A | | 12/1965 | Brandon | 129/34 |
| 3,257,127 | A | | 6/1966 | Tilton, Jr. | 281/31 |
| 3,473,246 | A | * | 10/1969 | Parobek | 40/124.4 |
| 4,667,828 | A | | 5/1987 | Samuelson | |
| 4,786,083 | A | * | 11/1988 | King | 281/50 |
| D303,809 | S | | 10/1989 | Klein | D19/27 |
| 4,907,904 | A | | 3/1990 | Baldwin | 402/80 R |
| 4,920,673 | A | * | 5/1990 | Mitsuyama | 40/124.2 |
| D322,458 | S | | 12/1991 | Wiberg | D19/27 |
| 5,186,565 | A | * | 2/1993 | Jack | 283/65 |
| 5,219,437 | A | * | 6/1993 | Moor et al. | 281/37 |
| 5,348,347 | A | * | 9/1994 | Shink | 150/135 |
| 5,732,977 | A | | 3/1998 | Kohana | 281/45 |
| 5,915,874 | A | * | 6/1999 | Wilson et al. | 40/777 |
| 5,961,150 | A | * | 10/1999 | Kogutt et al. | 281/37 |
| 5,975,578 | A | * | 11/1999 | Mayer | 281/37 |
| 5,988,404 | A | * | 11/1999 | Wilen | 281/15.1 |
| 6,129,388 | A | * | 10/2000 | Bromberg | 283/65 |
| 6,276,722 | B1 | * | 8/2001 | Moor | 281/37 |

FOREIGN PATENT DOCUMENTS

| | | |
|---|---|---|
| DE | 7513256 | 9/1975 |

* cited by examiner

*Primary Examiner*—A. L. Wellington
*Assistant Examiner*—Mark T. Henderson
(74) *Attorney, Agent, or Firm*—Thompson Hine LLP

(57) ABSTRACT

A system for mounting a component to a portfolio including a tongue located on the component, the tongue having a tail portion and a tip portion, and a portfolio having a tongue opening formed therein. The top can be inserted into the tongue opening and component rotated relative to the portfolio until the tongue is generally received through the tongue opening to couple the component to the portfolio.

19 Claims, 13 Drawing Sheets

MOUNTING SYSTEM FOR A PORTFOLIO

BACKGROUND OF THE INVENTION

The present invention is directed to a mounting system for a portfolio, and more particularly, to a mounting system for coupling various components to the inside cover of a portfolio.

Portfolios are widely used to store looseleaf papers, folders, notebooks, storage pockets and other loose items. It is often desired to securely couple the components to the portfolio so that the components do not become separated from the portfolio. However, it is preferred that the components be releasably coupled to the portfolio so that the components can be replaced or removed upon suffering damage or wear. Accordingly, there is a need for a system for securely yet releasably coupling a component to a portfolio.

SUMMARY OF THE INVENTION

The present invention is a system for coupling a component to a portfolio in a secure, yet releasable manner. The component includes a tongue and the portfolio includes a slot shaped to receive the tongue. The tongue is generally curved such that the component must be rotated to fit the tongue into the slot of the portfolio.

In a preferred embodiment, the invention is a system for mounting a component to a portfolio comprising a tongue located on the component, the tongue having a base portion and a tip portion, and a portfolio having a tongue opening formed therein. The tip can be inserted into the tongue opening and the component rotated relative to the portfolio until the tongue is generally received through the tongue opening to couple the component to the portfolio.

Other objects and advantages of the present invention will be apparent from the following description and the accompanying drawings.

DETAILED DESCRIPTION

Figure 1:
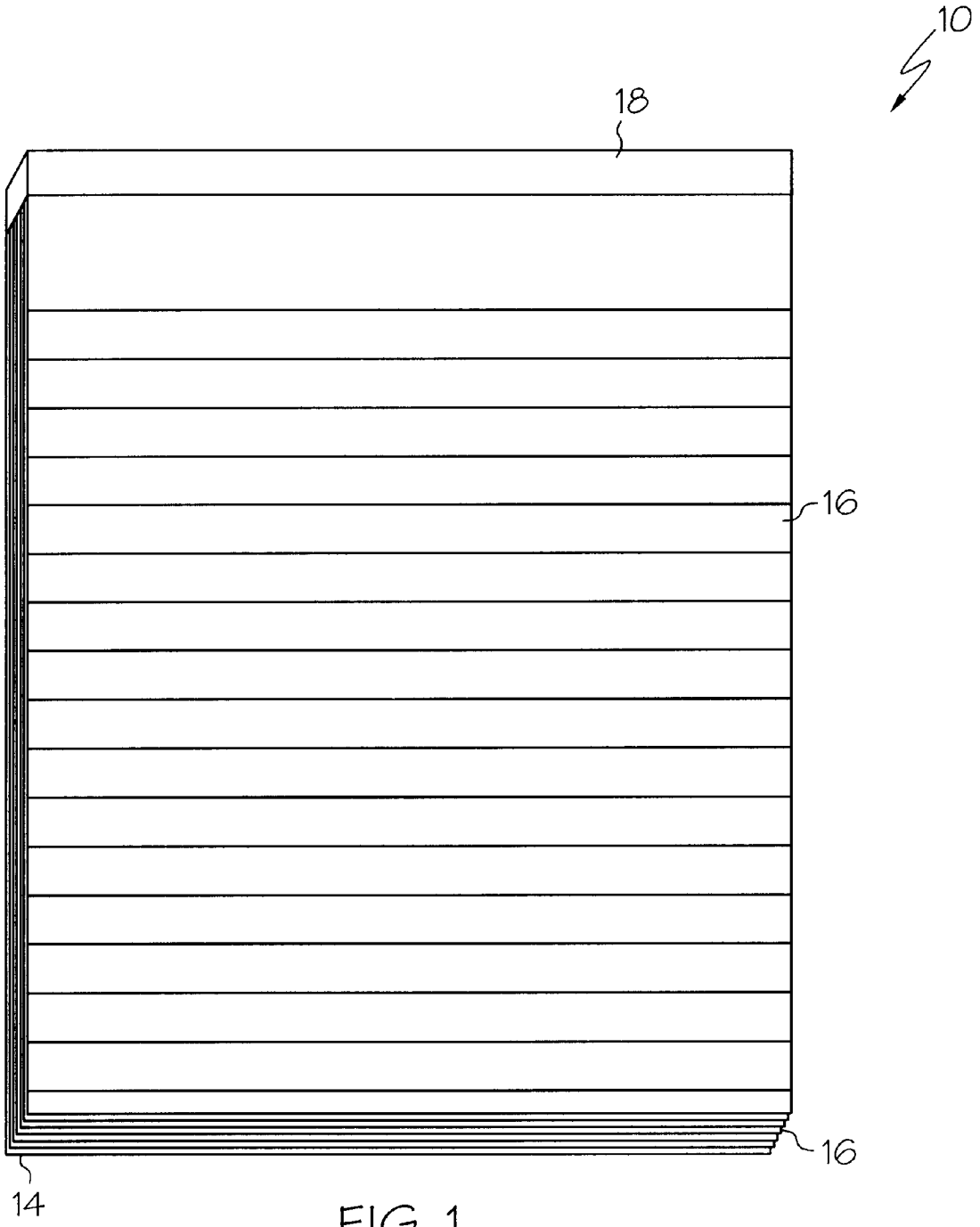
FIG. 1 is a top view of a notebook that may be used with the system of the present invention.
Figure 2:
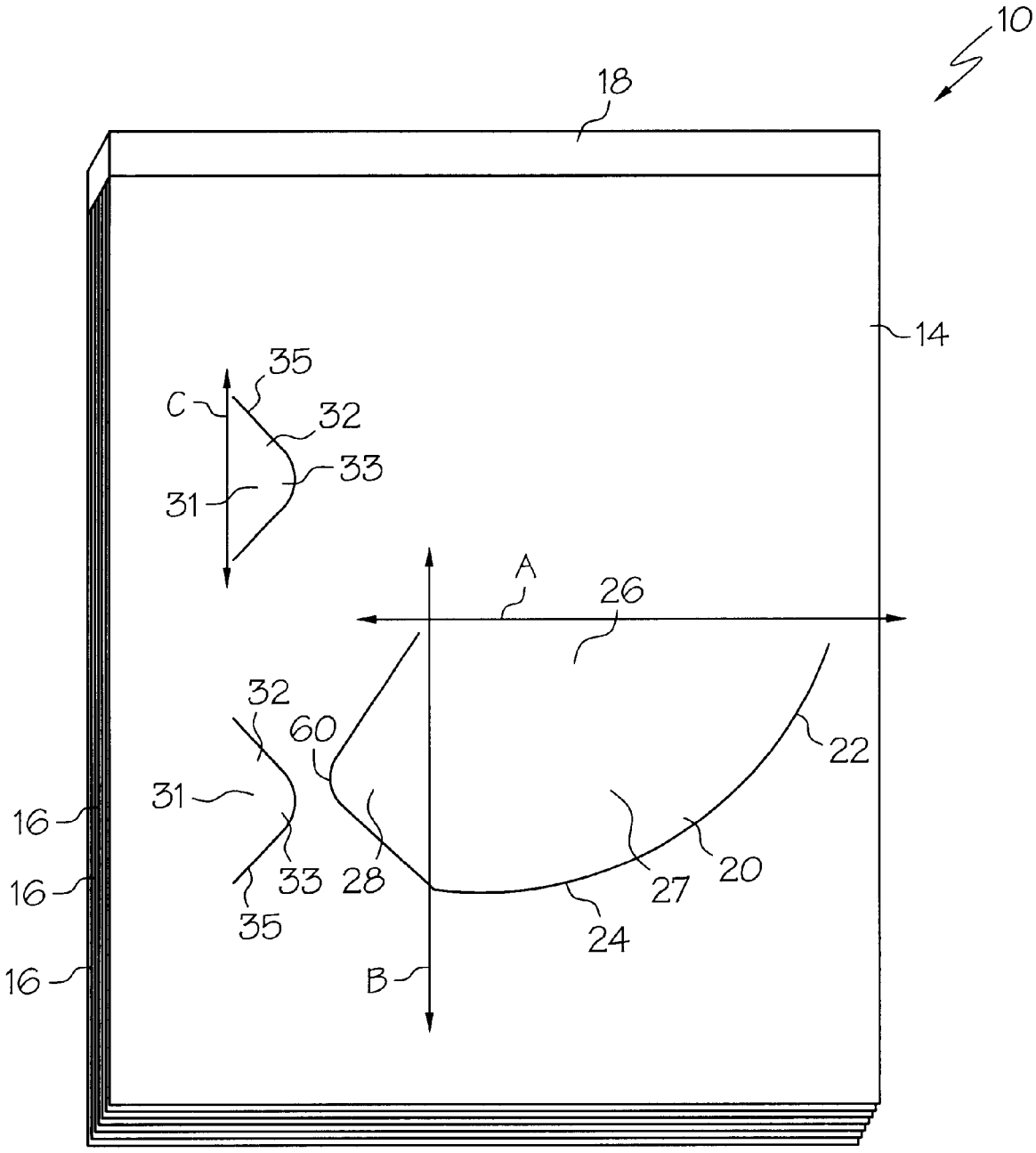
FIG. 2 is a back view of the notebook of FIG. 1.
Figure 3:
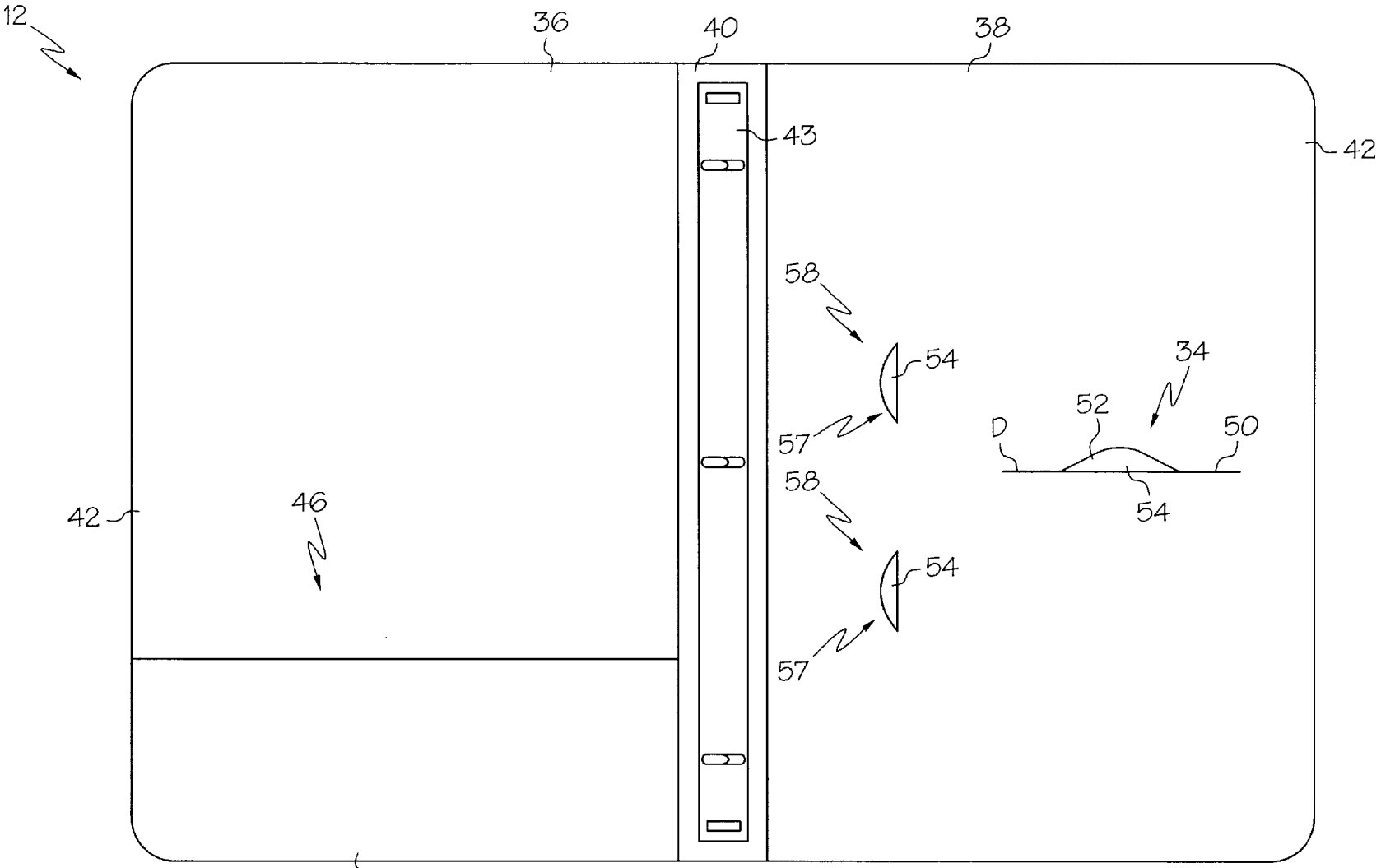
FIG. 3 is a top view of a portfolio used with the system of the present invention.

The present invention is a system for coupling or mounting a component 10 (FIGS. 1 and 2) to a portfolio 12 (FIG. 3). By portfolio it is meant nearly any type of binder, book, notebook, diary, planner, album, file, bulletin, flier, register, and the like. The component 10 shown in FIGS. 1–2 is a notebook that includes backing sheet 14 and a plurality of looseleaf sheets 16 stacked on top of the backing sheet 14.

The sheets 16 are bound together at their upper edges by a binding 18, and the sheets 16 are individually removable from the notebook. Although the component 10 is shown as a notebook, the component used with the present invention can be nearly any item or mechanism that is desired to be coupled to the portfolio 12, including but not limited to folders, pockets, binding mechanisms, calenders, electronic devices, decorative or ornamental components, school supplies and the like.

In the illustrated embodiment, the notebook includes a generally rigid backing sheet 14, preferably made of cardboard, having a tongue 20 formed therein, the tongue being defined by a cut 22 in the backing sheet 14. The tongue 20 includes a tip portion 28, a base portion 26, and a generally curved tail portion 27 located between said tip portion and said base portion. The cut 22 includes a generally curved portion 24 that extends from the base portion 26 to the tip portion 28 to define a curved edge of the tongue 20. The tip portion 28 extends at an angle relative to the base portion 26; that is, line A, which extends across the width of the base portion 26, is generally perpendicular to the line B which extends across the width of the tip portion 28. The backing sheet 14 further includes a pair of tabs 32 formed in the backing sheet 14, each tab being defined by a cut 35 in the backing sheet. Each tab 32 includes a base portion 31 and a tip portion 33. In a preferred embodiment, a line extending across the width of the base portion 31 of each tab 32 (indicated by line C) is generally perpendicular to a line extending across the width of the base portion 26 of the tongue 20 (line A).

As shown in FIG. 3, the portfolio 12 is preferably a typical three ring binder including a pair of covers 36, 38, a spine 40, and a binding mechanism 43 mounted onto the spine. The portfolio 12 may be made in a variety of manners, but in a preferred embodiment the portfolio includes three relatively rigid pieces of cardboard, each piece forming one of the covers 36, 38 and spine 40. A piece of plastic or other flexible material is then formed as an outer jacket 42 over the three pieces of cardboard, and joins the pieces together to create the portfolio 12. Another piece of flexible material 44 is preferably located on the cover 36 to form a pocket 46.

The cover 38 includes a tongue opening, generally designated 34. In the illustrated embodiment, the tongue opening 34 includes a generally horizontally-extending tongue opening slit 50 cut in the outer jacket 42, and a generally hemispherical opening 52 cut in the outer jacket 42 to expose a piece of cardboard 54 forming the cover 38 underlying the outer jacket 42. The tongue opening 34 preferably has a width that is about equal to or slightly greater than the width of the tongue 20. The portfolio 12 further includes a pair of generally vertically-extending tab openings 58, each tab opening preferably being formed by a tab opening cutout 57 cut in the outer jacket 42.

FIGS. 4–7 illustrate a sequence of operations to couple the notebook 10 of FIGS. 1–2 to the portfolio 12 of FIG. 3. However, for ease of illustration in FIGS. 4–7, the notebook 10 of FIGS. 1–2 has been modified such that all of the sheets 16 are removed, thereby exposing the backing sheet 14.

Figure 4:
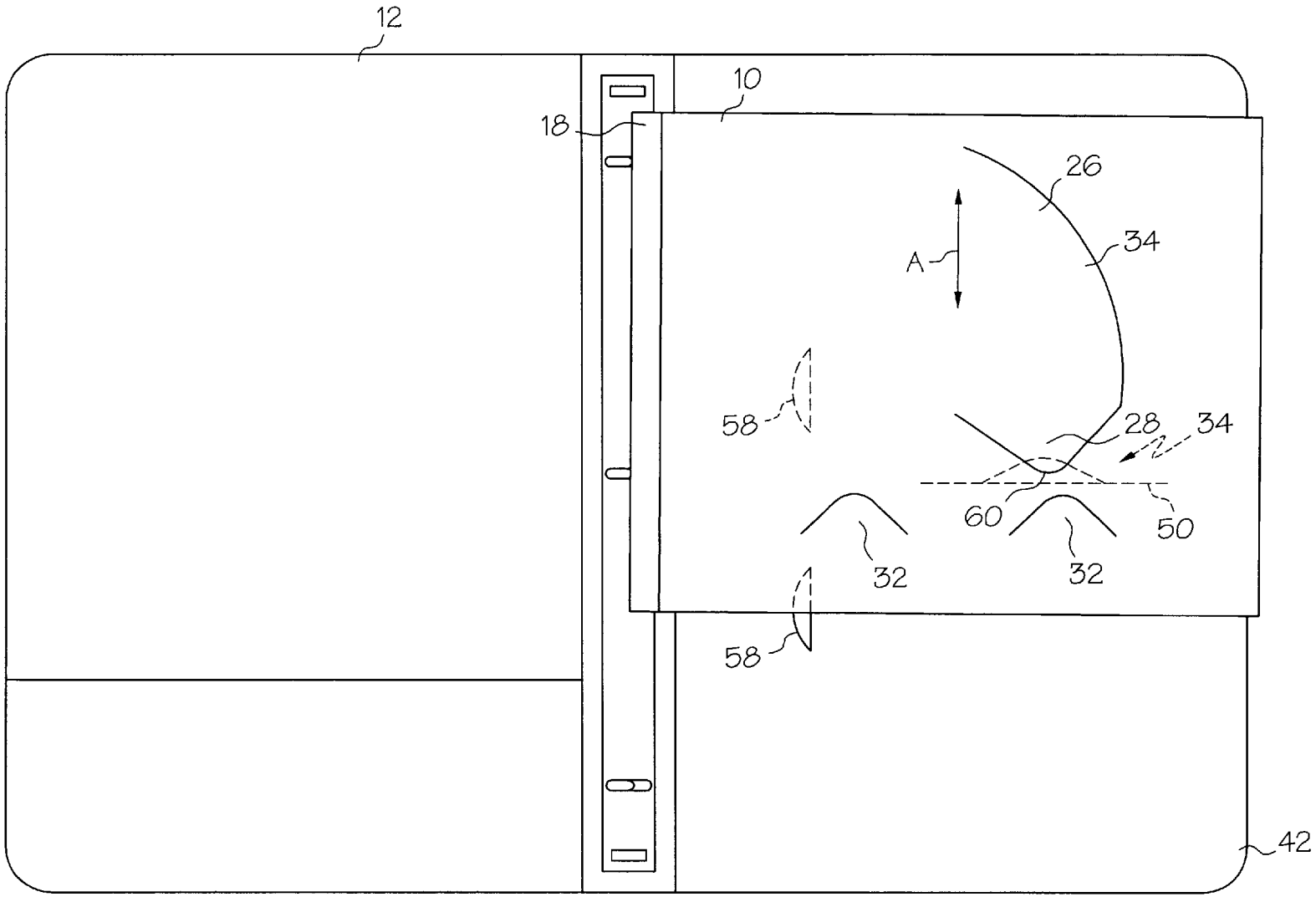
FIGS. 4–7 are a series of top views showing the notebook of FIGS. 1–2 being coupled to the portfolio of FIG. 3.

In order to couple the component 10 to the portfolio 12, the tip portion 28 of the tongue 20 is aligned with the tongue opening 34 of the portfolio, as shown in FIG. 4. The tip portion 28 includes a nose 60 that includes two angled, converging edges that are shaped to guide the tip portion 28 into the tongue opening 34. In the mounting orientation shown in FIG. 4, the base portion 26 of the tongue 20 is generally perpendicular to the tongue opening 34. That is, the line A which extends across the base portion 26 is generally perpendicular to the slit 50 which extends across the tongue opening 34. The component 10 is also generally perpendicular to the portfolio 12 in this orientation.

Figure 5:
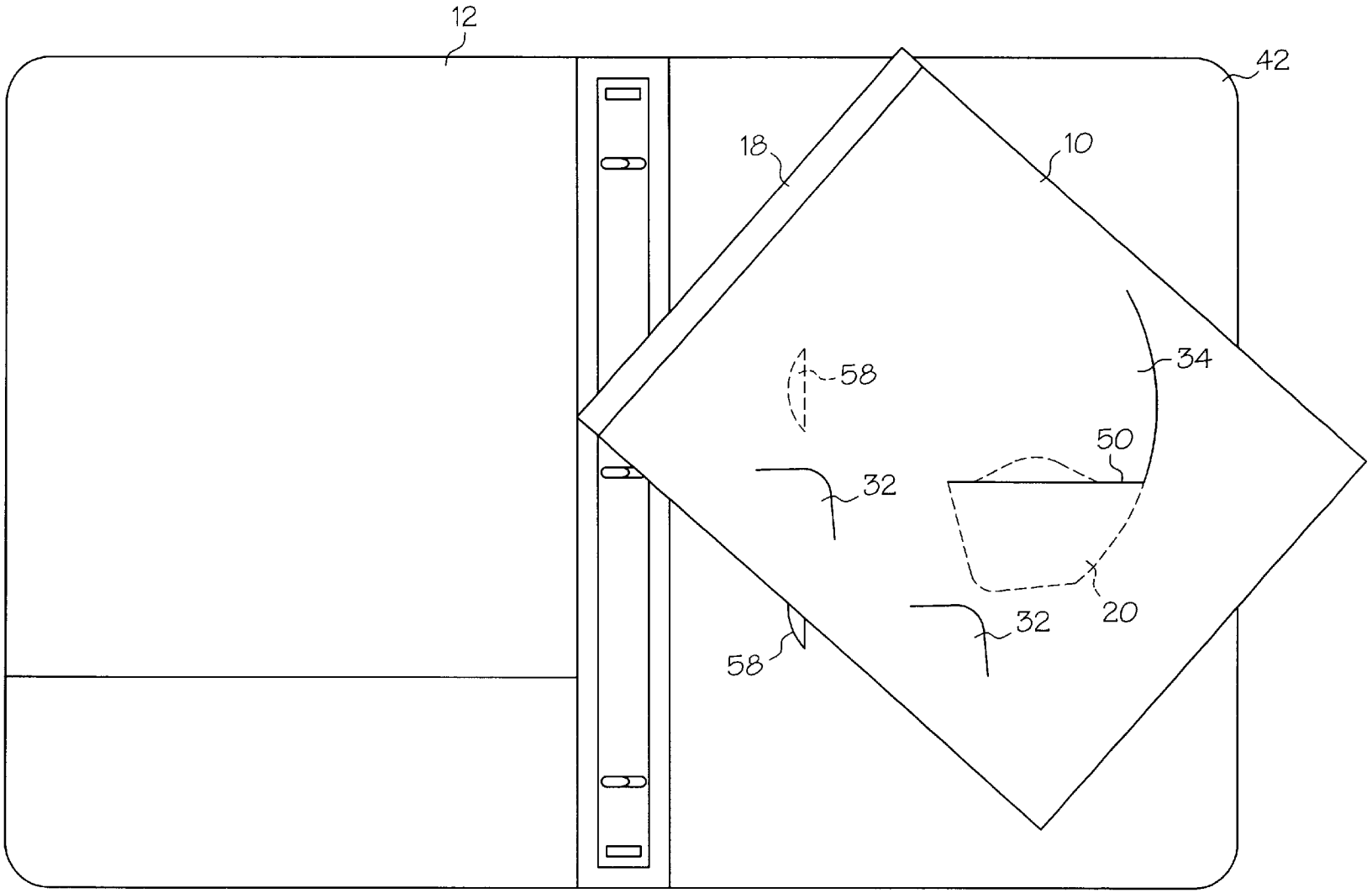
Figure 6:
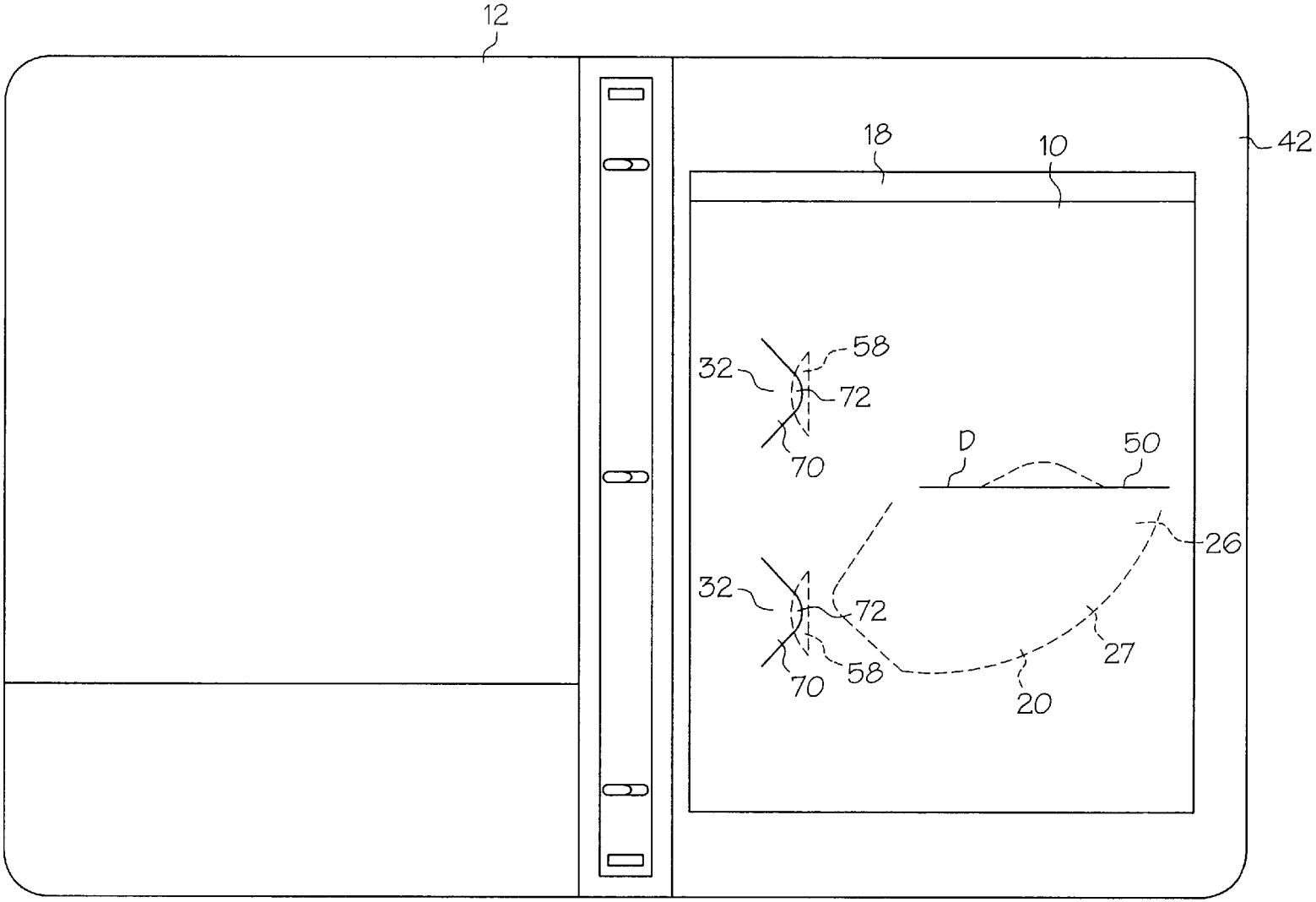

The tip portion 28 of the tongue 20 is first inserted into the tongue opening 34. The component 10 is then rotated approximately 90 degrees relative the portfolio 12 such that the tongue 20 slides in and through the slit 50 and is received in the tongue opening 34 and behind the outer jacket 42, as shown in FIGS. 5–6. During this step the tongue 20 is rotated clockwise in FIGS. 4–7 about imaginary point D on the tongue opening 34. The point D is located opposite the curved edge 24 of the tongue 20 when the tongue is inserted into the opening 34.

Figure 7:
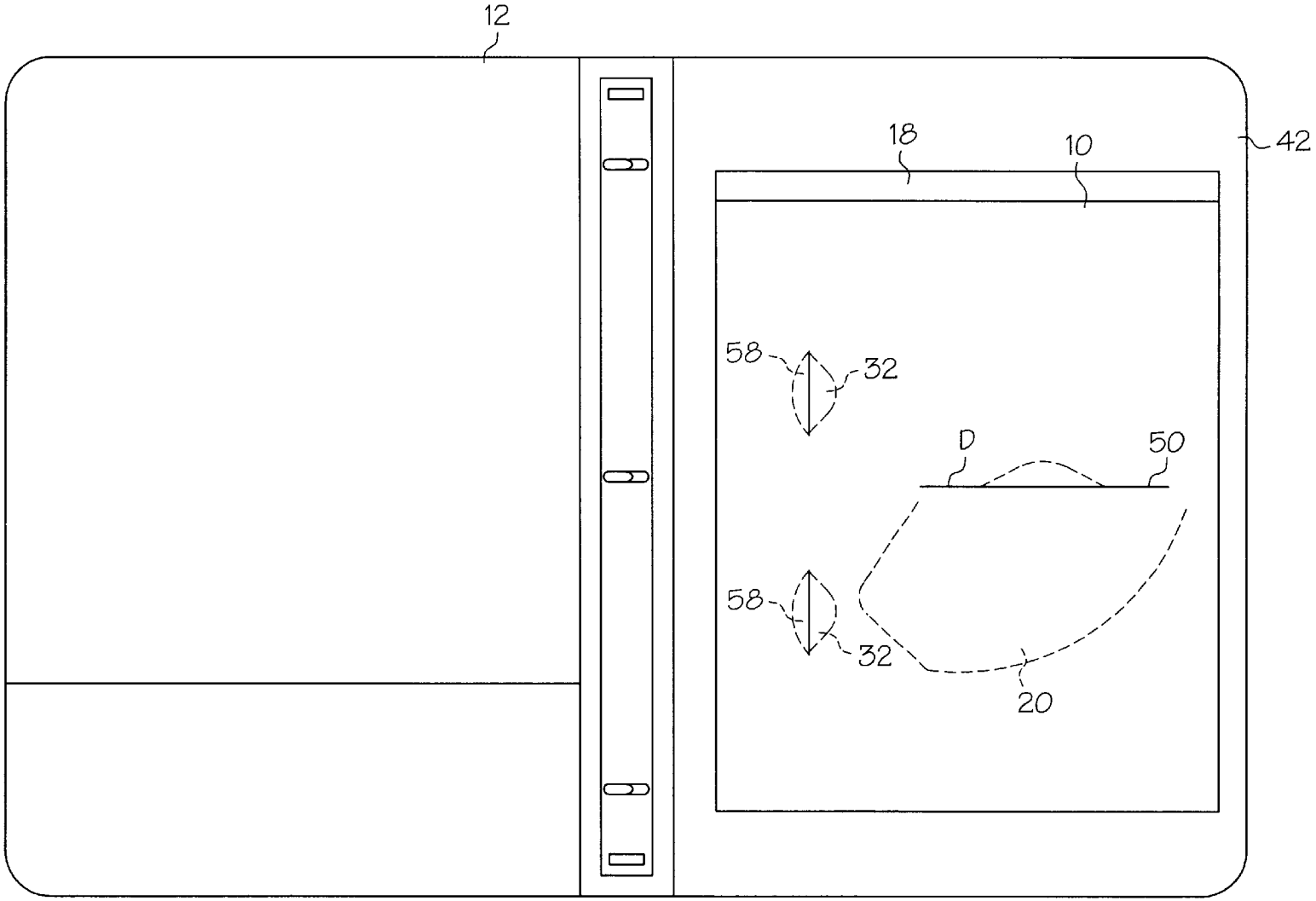

After the 90 degree rotation of the portfolio 12, the component is in its configuration shown in FIG. 6. The component 10 is now secured to the portfolio 12, and is generally aligned within the portfolio. Furthermore, each tab 32 on the component 10 is aligned with a respective tab opening 58. Next, the component 10 is shifted to the right relative to the portfolio 10 to slide each tab 32 into a tab opening 58 and below the outer jacket 42, as shown in FIG. 7. Once the tabs 32 are slid into an associated tab opening 58, the tabs/tab openings further secure the component 10 to the portfolio 12 by preventing rotation of the component 10 relative the portfolio 12. The tabs 32 thereby help to prevent the accidental rotation, or uncoupling, of the component 10 relative to the portfolio 12.

In order to uncouple the component 10 from the portfolio 12, the component 10 is shifted to the left of its position shown in FIG. 7 to remove the tabs 32 from the tab openings 58. The component 10 is then rotated counterclockwise to remove the tongue 20 from the tongue opening 34. Another component of various shapes or sizes having a tongue 20 can then be coupled to the portfolio 12 as described above.

Figure 8:
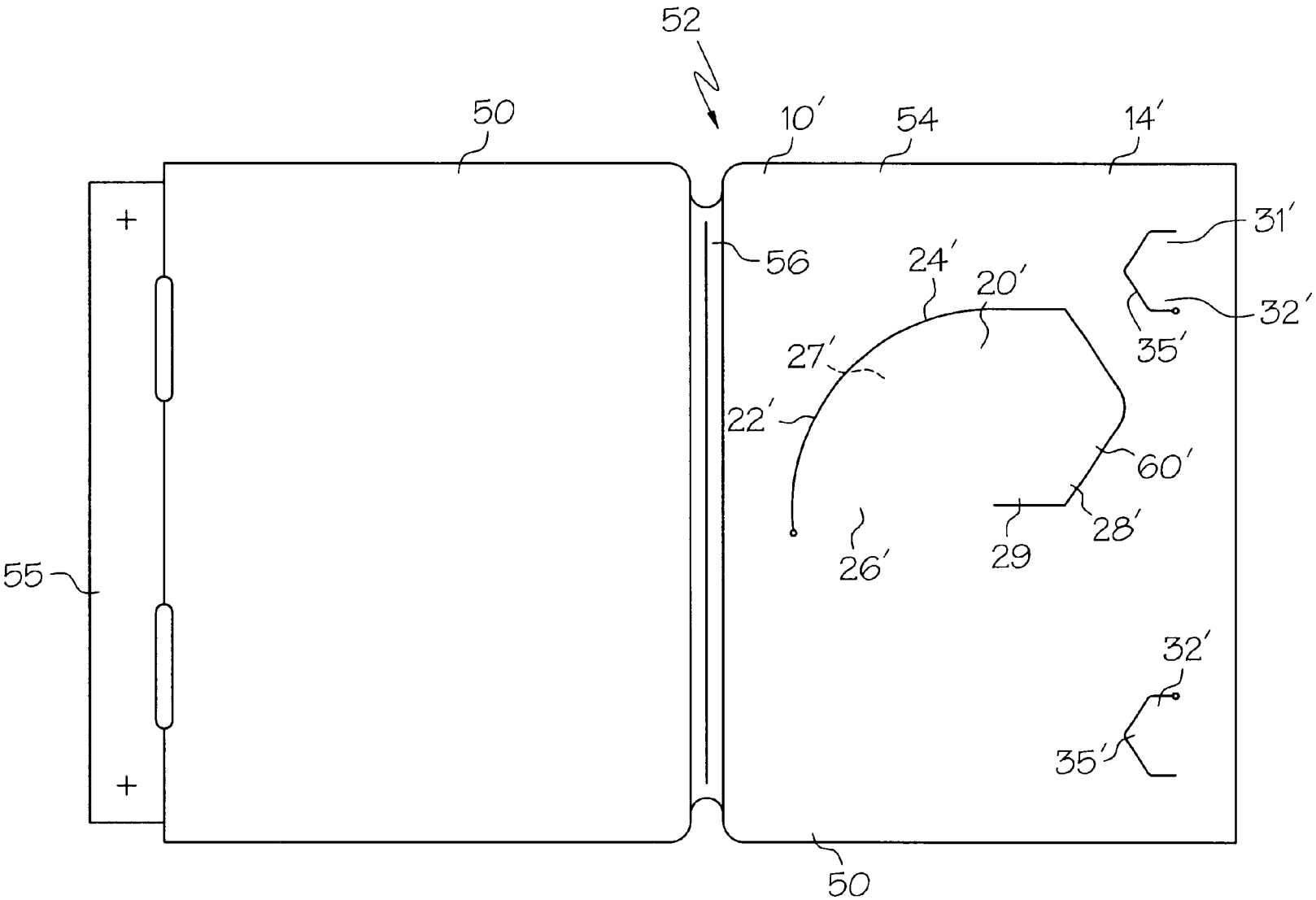
FIG. 8 is a top view of a pocket, in its unfolded condition, that may be used with the system of the present invention.
Figure 9:
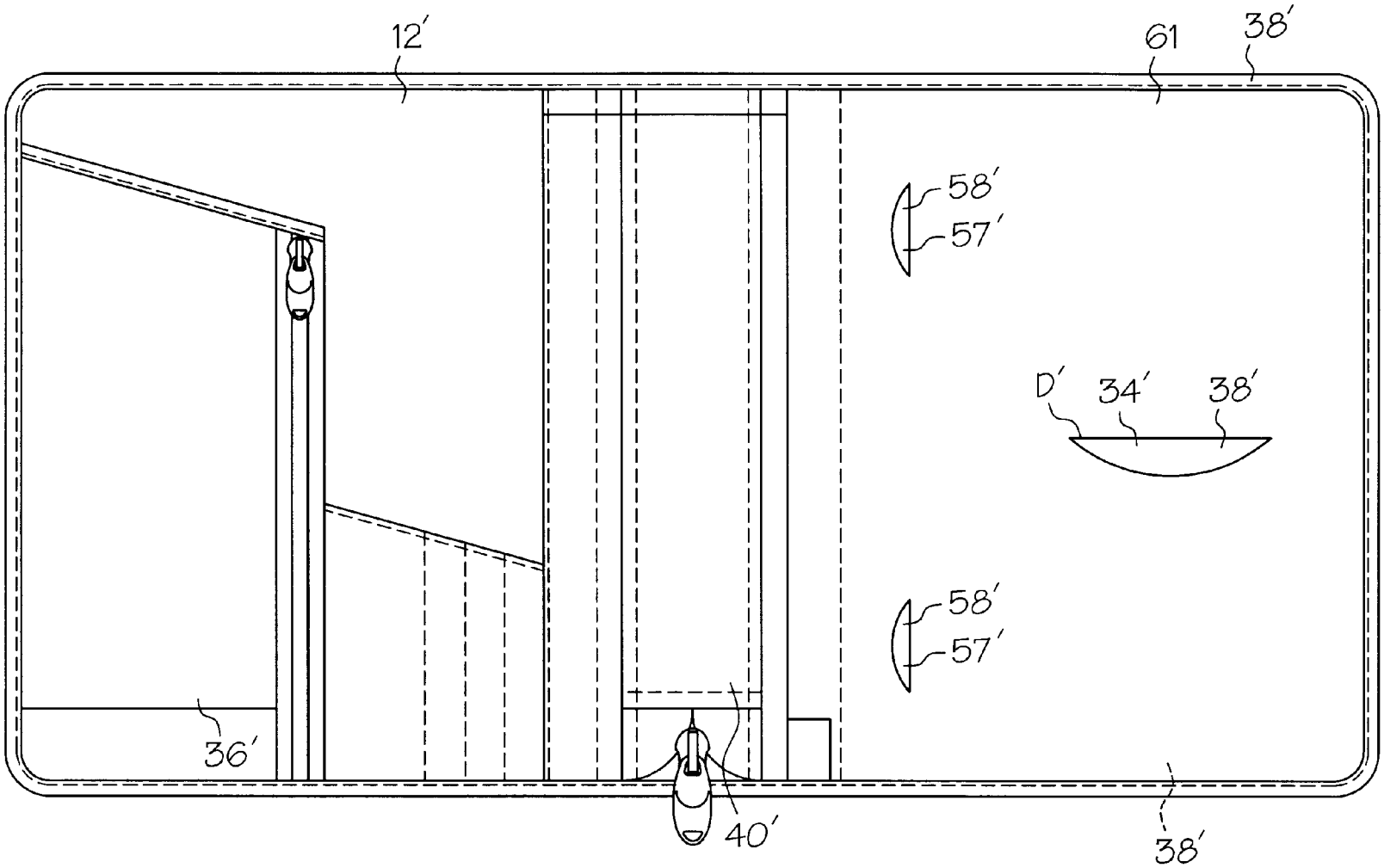
FIG. 9 is a top view of a portfolio that may be used with the system of the present invention.

FIG. 8 illustrates an alternate embodiment of the component 10, shown as a component 10'. The element numbers shown in FIGS. 8–12 and described hereinbelow that include a prime correspond to the element having the same number without a prime shown in FIGS. 1–7 and described above. The component 10' is a pocket 52, and FIG. 8 illustrates the pocket 52 in its unfolded condition. In order to form the pocket 52, the top panel 50 of the pocket 52 is folded about the spine portion 56 until the top panel is located on top of and spaced apart from the bottom panel 54. The pocket 52 also includes side panels (not shown) that extend between thee sides of the top panel 50 and bottom panel 54 to complete the pocket 52. The side panels are preferably gusseted to provide an expandable pocket. In an alternate embodiment, the pocket 52 includes a binding mechanism (not shown), such as a three ring binder, mounted on an extention portion 55 of the top panel 50. The pocket 52 is shown in its assembled condition in FIGS. 10–12.

The bottom panel 54 includes a tongue 20' formed by a cut 22' in the bottom panel 50. The tip portion 28' of tongue 20' is "extended" compared to the tip portion 28 of the notebook of FIGS. 1–2, and the extended tip portion 28' includes a generally straight portion 29. Furthermore, the location of the tongue 20' and tabs 32' of the pocket 52 on the component 10' are generally reversed from the orientation of the tongue 20 and tabs 32 of the first embodiment of the component 10. The portfolio 12' illustrated in FIG. 9 includes a piece of material, such as plastic attached to the cover 38' to form an outer jacket 61. The tongue opening 34' and tab openings 58' are cut in the jacket 61, exposing the cover 38' below.

Figure 10:
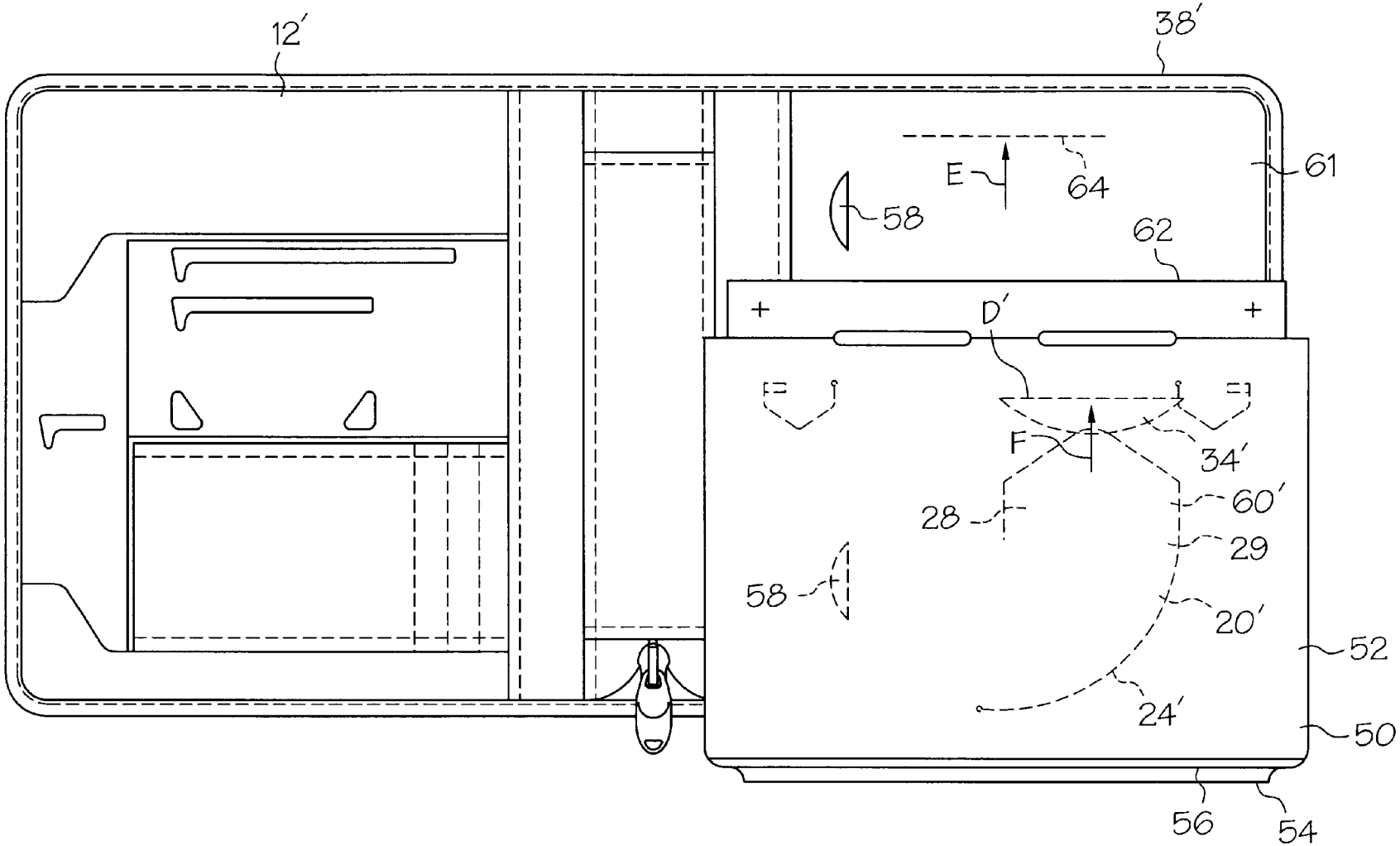
FIGS. 10–12 are a series of top view showing the assembled pocket of FIG. 8 being coupled to the portfolio of FIG. 9.
Figure 11:
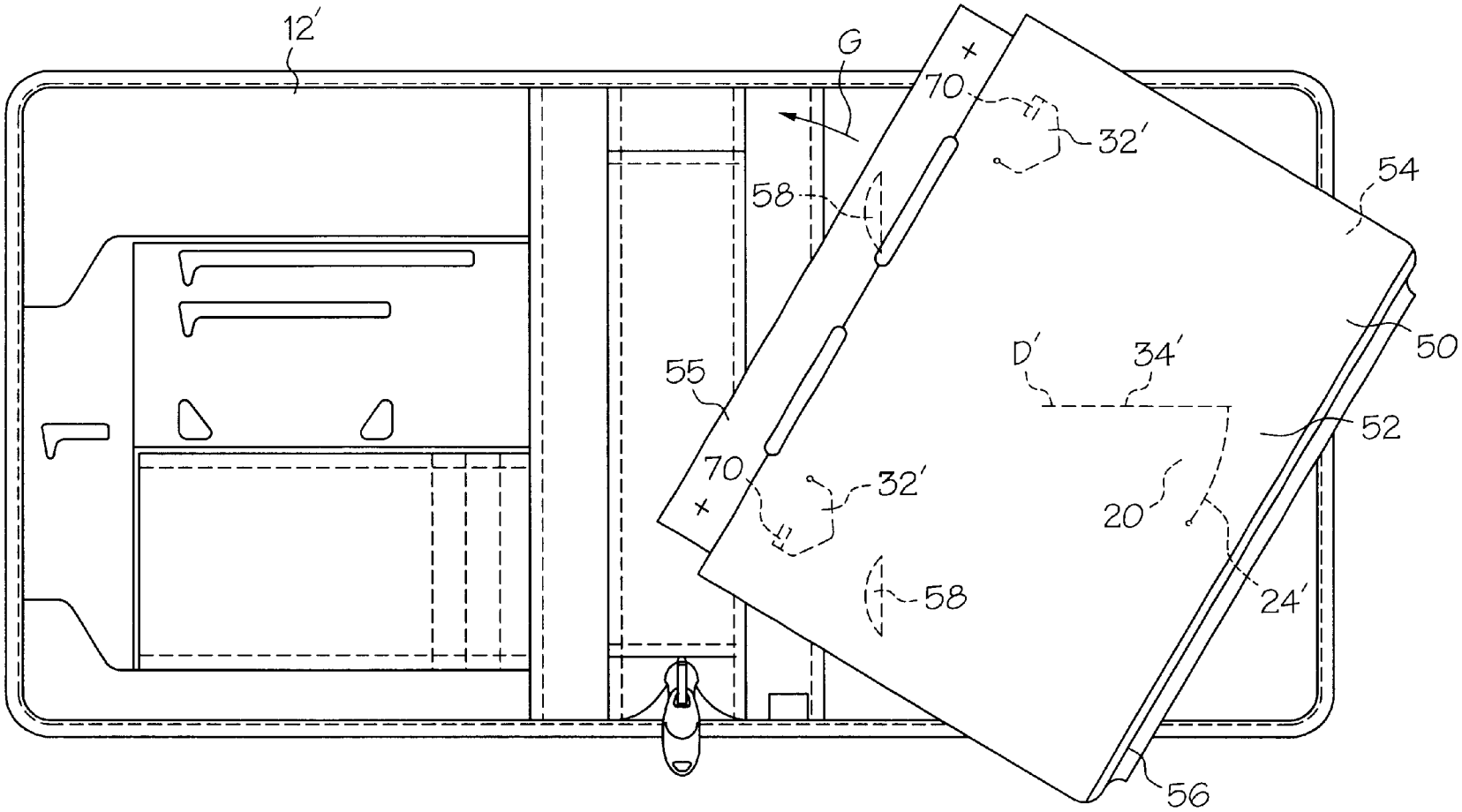
Figure 12:
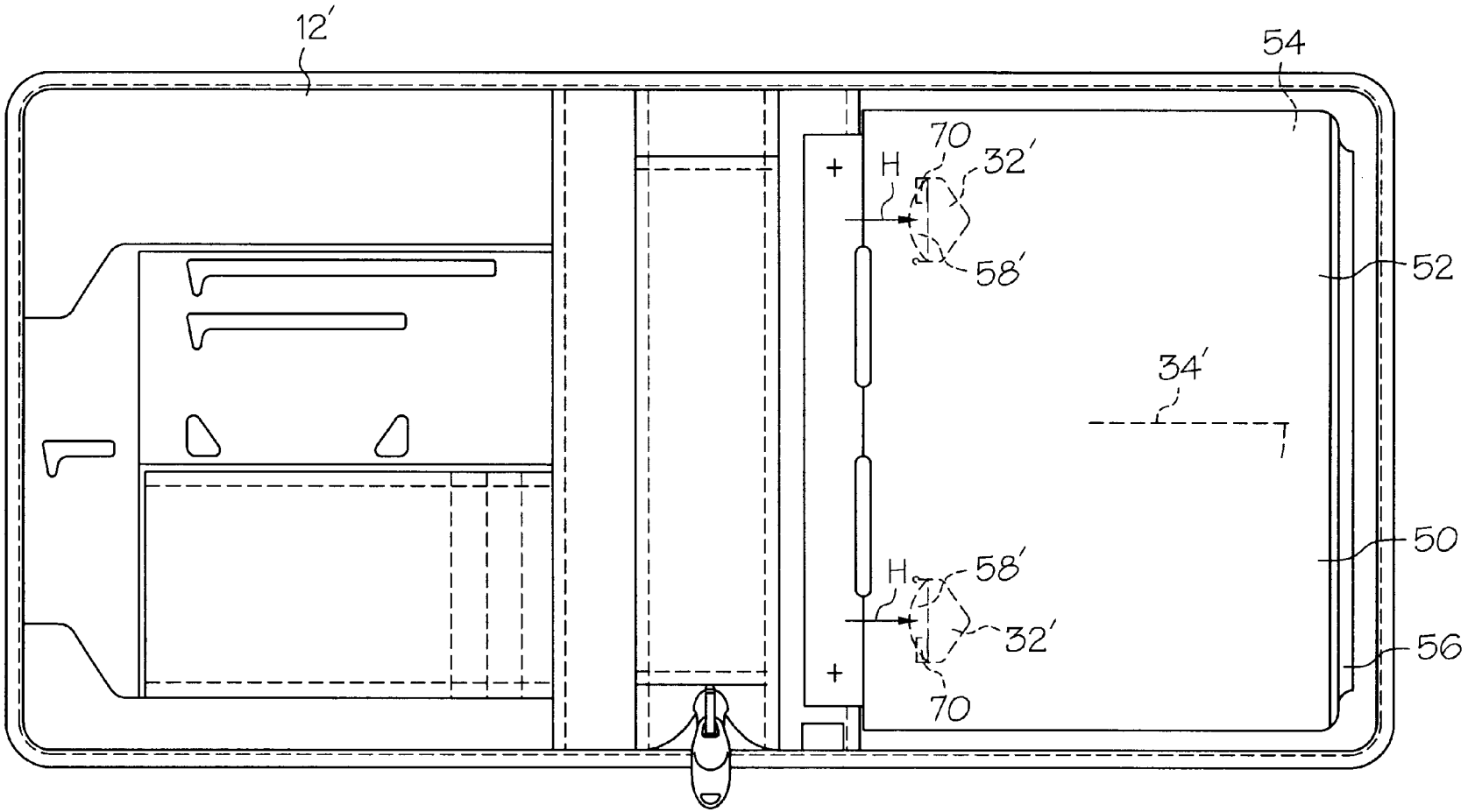

FIGS. 10–12 illustrate the sequence of operations to couple the pocket 52 to the pocket 52. As shown in FIG. 10, the pocket 52 is aligned such that the tip 60' of the tongue 20' is aligned with the tongue opening 34'. The pocket 52 is then moved in the direction of arrow E, which slides the tongue 20' into the tongue opening 34', as indicated by arrow F. The pocket 52 is moved in the direction of the arrow E until the generally straight portion 29 of the tip portion 28' is received in the tongue opening 34'. At this point the side edge 62 of the pocket 52 is aligned with imaginary line 64 of FIG. 10.

The pocket 52 is then rotated in a counter-clockwise direction about point D', as indicated by arrow G in FIG. 11, to slide the curved edge 24' of the tongue 20' into the tongue opening 34'. Once the tongue 20' is fully received in the tongue opening 34', as shown in FIG. 12, the tabs 32' are aligned with the tab openings 58' in the portfolio 12'. The pocket 52 is then moved in the direction of arrows H to slide the tabs 32' into the tab openings 58, and thereby couple the pocket 52 to the portfolio 12'. The tabs 32' may each include a notch 70 to aid in coupling the pocket 52 to the portfolio 12'.

Figure 13:
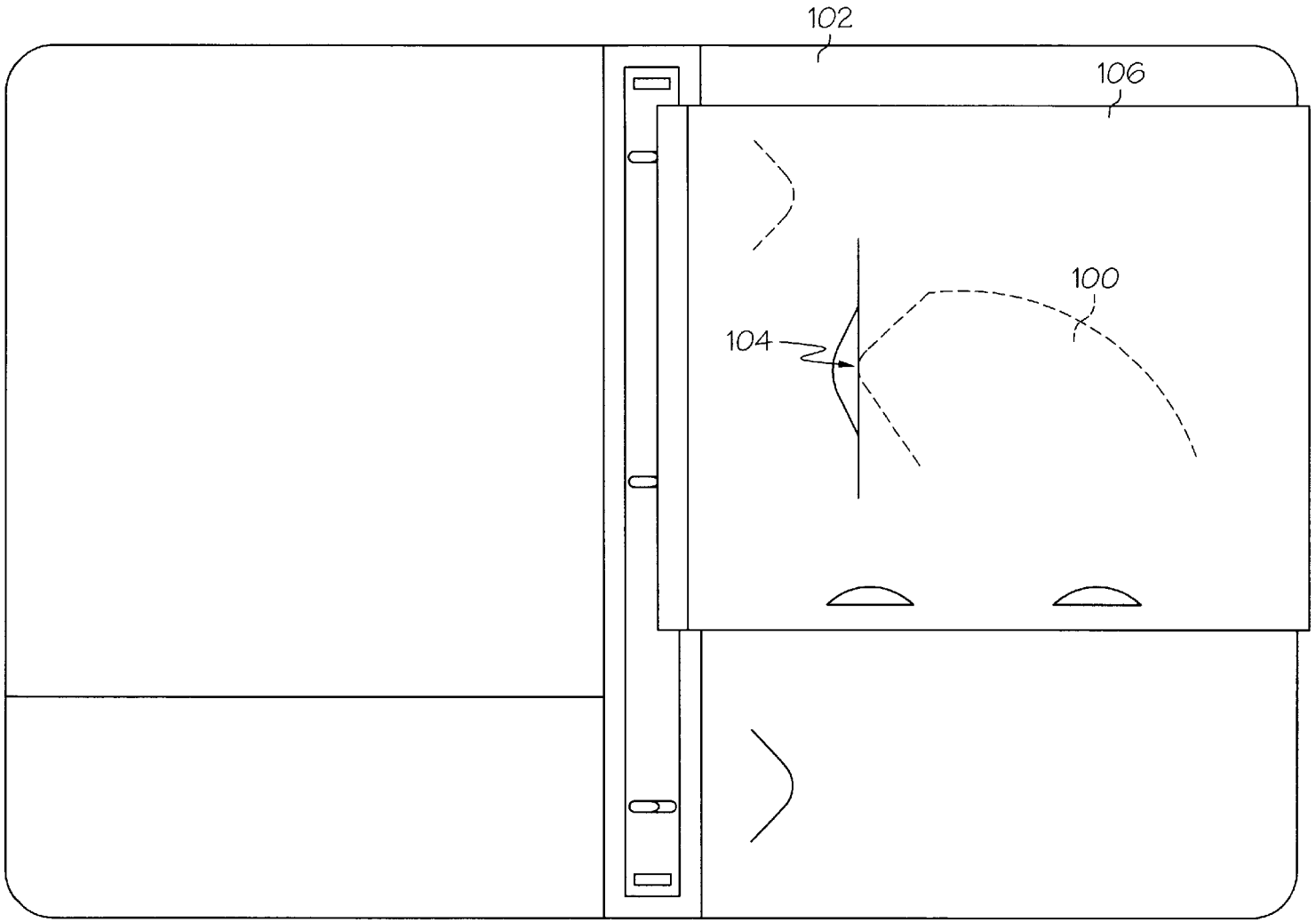
FIG. 13 is a top view of an alternate embodiment of the system of the present invention.

In an alternate embodiment of the invention (FIG. 13), the tongue 100 is located on the portfolio 102, and the tongue opening 104 is formed on the component 106, and the component 106 is rotated relative to the portfolio 102 to couple and slide the tongue 100 into the tongue opening 104, thereby coupling the component 106 to the portfolio 102.

Having described the invention in detail and by reference to the preferred embodiments, it will be apparent that modifications and variations thereof are possible without departing from the scope of the invention.

What is claimed is:

1. A system for assembling a component with a portfolio comprising:

a tongue located on one of said component or said portfolio, said tongue having a base portion coupled to said one of said component or portfolio, said base portion having a width direction extending across a width of said base portion, said tongue further including a tip portion and a tail portion located between said base portion and said tip portion, said tip portion having a width direction, said tongue including a curved edge, said width direction of said tip portion forming an angle with said width direction of said base portion; and the other of said portfolio or said component having a tongue opening formed therein, wherein component can be assembled with said portfolio by inserting said tip portion into said tongue opening and causing relative rotation between said portfolio and said component such that said tongue is received through said tongue opening to couple said component to said portfolio wherein component includes a backing sheet, and wherein said tongue is defined by a cut in said backing sheet.

2. The system of claim 1 wherein said component is a notebook including a plurality of removable paper sheets coupled to said backing sheet.

3. The system of claim 1 wherein said component is an expandable pocket.

4. The system of claim 1 wherein said backing sheet and said tongue are made of cardboard.

5. The system of claim 1 wherein said component is rotated relative to a point on said tongue opening opposite said curved edge to couple said component to said portfolio.

6. A component for mounting to a portfolio having an opening formed therein, the component comprising a body having a tongue, said tongue having a tip portion and a tail portion having a curved edge, wherein said tip portion can be inserted into said opening and said component rotated relative to said portfolio until said tongue is generally received through said opening to couple said component to said portfolio wherein said component is an expandable pocket, and wherein said body is a bottom panel of said expandable pocket.

7. A portfolio for receiving a component thereon, said component having an opening formed therein, the portfolio comprising a body having a tongue, said tongue having a tip portion and a tail portion having a curved edge, wherein said tip portion can be inserted into said opening and said component rotated relative to said portfolio until said tongue is generally received through said opening to couple said component to said portfolio.

8. A system for coupling a component and a portfolio comprising:

a tongue located on said component, said tongue having a tip portion and a tail portion including a curved edge, said component including a backing sheet, said tongue being defined by a cut in said backing sheet; and said portfolio having a tongue opening formed therein, wherein said component can be coupled to said portfolio by inserting said tip portion into said tongue opening and causing relative rotation between said portfolio and said component such that said tongue is received through said tongue opening to couple said component to said portfolio.

9. A system for coupling a component to a portfolio comprising:

a tongue located on one of said component or said portfolio, said tongue having a tip portion and a tail portion including a curved edge; and the other of said portfolio or said component having a tongue opening formed therein, wherein component can be assembled with said portfolio by inserting said tip portion into said tongue opening and causing relative rotation between said portfolio and said component such that said tongue is received through said tongue opening to couple said component to said portfolio when said component is rotated relative to a point on said tongue opening opposite said curved edge when said tip portion is inserted in said tongue opening.

10. The system of claim 9 wherein said tongue opening is defined by a tongue opening slit in said component or portfolio.

11. The system of claim 9 wherein said portfolio includes at least one panel and an outer jacket generally covering said at least one panel, and wherein said tongue opening is a slit cut in said outer jacket.

12. The system of claim 9 wherein said tip portion includes a nose shaped to guide said tip portion into said tongue opening.

13. The system of claim 9 wherein said tip portion has a width that is about equal to the width of said tongue opening.

14. The system of claim 9 further comprising a tab located on one of said component or said portfolio, and wherein the other of said component or portfolio includes a tab opening, said tab opening being shaped and located to receive said tab therethrough when said tongue is received through said tongue opening to prevent rotation of said component relative said portfolio.

15. The system of claim 9 wherein said width direction of said tip portion forms an angle of about 90 degrees with said width direction of said base portion.

16. The system of claim 10 wherein said width direction of said base portion forms an angle with said slit when said tip portion is initially inserted into said tongue opening.

17. The system of claim 14 wherein said tab opening is defined by a tab opening slit in said component or said portfolio.

18. The system of claim 14 wherein said tab is defined by a cut in said component or said portfolio.

19. The system of claim 14 wherein said tab includes a base portion and a tip portion, a width of said base portion of said tab being generally perpendicular to said width of the said base portion of said tongue.

* * * * *